United States Patent [19]

Lach

[11] Patent Number: 4,947,015

[45] Date of Patent: Aug. 7, 1990

[54] PROCESS FOR THE CONTROL OF THE FEED MOTION AND TOUCH-ON MOTION OF A GRINDING WHEEL

[76] Inventor: Horst Lach, Dammstr. 6, D-6450 Hanau, Fed. Rep. of Germany

[21] Appl. No.: 236,065

[22] Filed: Aug. 24, 1988

[30] Foreign Application Priority Data

Aug. 26, 1987 [DE] Fed. Rep. of Germany ..... 3728390

[51] Int. Cl.[5] ..... B23H 5/04

[52] U.S. Cl. ..... 219/69.2; 51/165.87

[58] Field of Search ..... 219/69.2; 51/165.71, 51/165.74, 165.75, 165.76, 165.77, 165.87; 364/474.06; 318/569, 570, 685

[56] References Cited

U.S. PATENT DOCUMENTS

| | | | |
|---|---|---|---|
| 3,811,228 | 5/1974 | Nagashima et al. | 51/165.71 |
| 4,085,554 | 4/1978 | Sugita | 51/165.87 |
| 4,484,413 | 11/1984 | Yamamoto et al. | 364/474.06 |
| 4,641,007 | 2/1987 | Lach | 219/69.2 |
| 4,662,122 | 5/1987 | Ohmura et al. | 51/165.71 |

FOREIGN PATENT DOCUMENTS

| | | | |
|---|---|---|---|
| 2842366 | 5/1979 | Fed. Rep. of Germany | 51/165.77 |
| 973324 | 11/1982 | U.S.S.R. | 51/165.77 |

*Primary Examiner*—A. D. Pellinen
*Assistant Examiner*—Geoffrey S. Evans
*Attorney, Agent, or Firm*—Larson and Taylor

[57] ABSTRACT

The process serves to control the step-by-step feed motion or touch-on motion of a grinding wheel (18) relative to a workpiece (10) or a measuring sensor. In so doing, a sequence of measured values of the power consumption of the rotary drive motor (24) of the grinding wheel (18) is recorded. If a specific sequence of measured current values remains under a certain limiting value, a further touch-on step is triggered. With the touch-on control system the touch-on motion is terminated, when the measured current values attain a specific limiting value. This touch-on control system forms the second phase of a combined touch-on control process in whose first phase a sparking current is generated and measured between the grinding tool (18) and the workpiece (10), which serves as a measurement of the distance between these.

10 Claims, 2 Drawing Sheets

Figure 1:
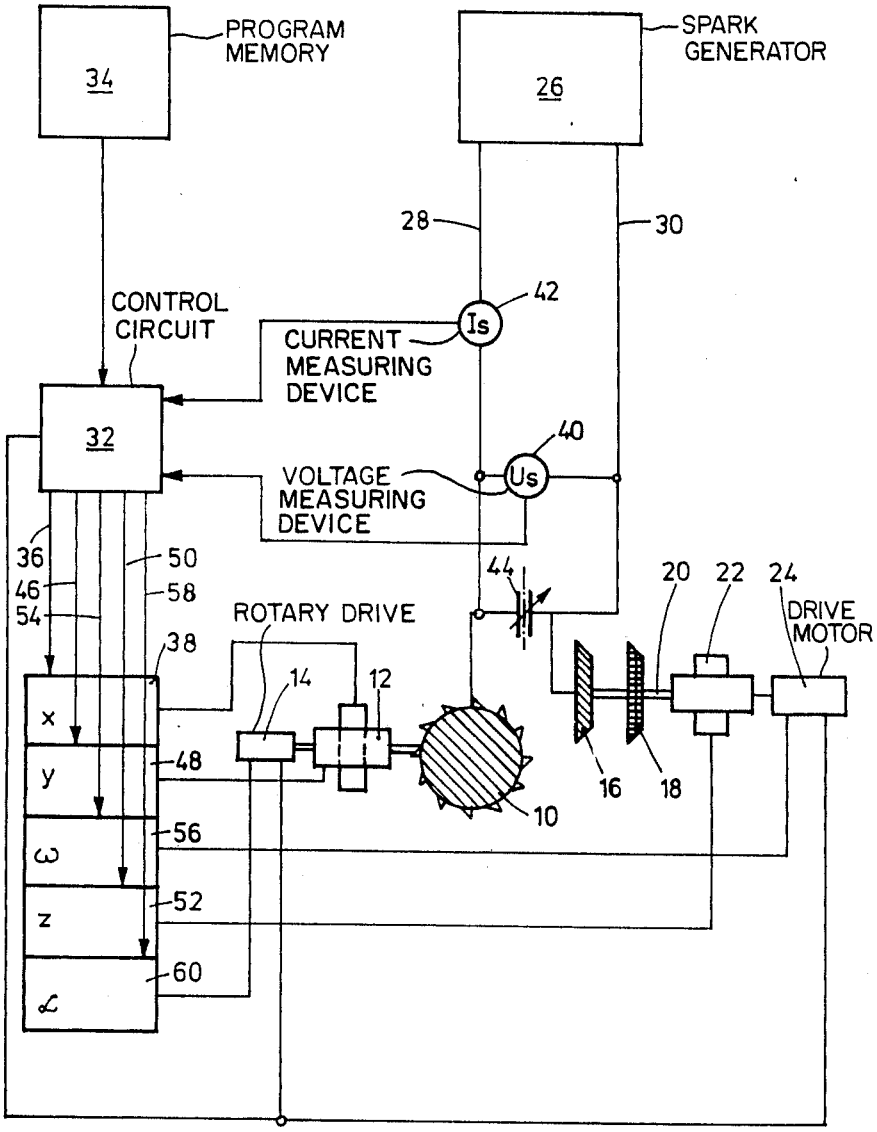

PROCESS FOR THE CONTROL OF THE FEED MOTION AND TOUCH-ON MOTION OF A GRINDING WHEEL

The invention relates to a process for the control of the step-by-step feed motion of a grinding wheel which is movable backward and forward relative to a workpiece surface to be machined parallel to the latter, and also for the control of the relative touch-on motion between a grinding wheel and a workpiece or a measuring sensor.

The step-by-step feed motion has been effected hitherto respectively in accordance with a specific number of backward and forward movements of the grinding wheel or of the workpiece. Abrasion on the part of the workpiece does however take place at differing speeds, depending on whether the exposed grains of the grinding wheel are still largely sharp-edged or already blunted or whether hard grains last longer in individual places on the surface to be ground before they too are removed. This variation in machining duration for a certain degree of removel must be taken into consideration when setting the number of grinding operations after which a step-by-step feed motion should take place each time and a sufficiently large number of backward and forward movements must in any case be preselected. However, it follows from this that in most cases a lesser number of grinding operations than those which have to be set by necessity would suffice until the next feed step. The inefficiency of the control process in practice hitherto expresses itself particularly strongly when grinding very hard workpieces, e.g. tools with inserts made of polycrystalline diamond or CBN, because in the case of these the number of grinding operations, not until after which does the next feed step of a specific size take place, is relatively high.

On the other hand with an unforeseen degree of blunting of the grinding wheel, it can happen that feed motion is effected at an even rhythm even though the foreseen removel has not yet been achieved. The grinding wheel then presses with unacceptable power against the workpiece, deforms it, or causes other damage.

It is therefore the object of the invention to create a control process of the kind mentioned at the beginning, by means of which the machining time is shortened and the fabrication defects quoted are effectively avoided, and this object is solved according to the invention in that each time a sequence of measured values of at least one mode of operating data of the grinding wheel's rotary drive is recorded for each backward and forward movement of the grinding wheel, which change with the friction torque acting upon the grinding wheel, and a feed motion occurs as soon as all measured values in a sequence remain on that side of a limiting value on which a maximum friction torque assigned to this is not exceeded.

The invention offers the advantage that neither is machine time wasted on unnecessary backward and forward movements of the grinding wheel, nor that fabrication defects are able to occur as a result of premature feed motion after insufficient removal, for, the feed motion is now effected at precisely the right point in time after a predetermined removal has been achieved.

Surprisingly it has been shown that in principle the same control process can be applied even before commencement of grinding work, in order to place the grinding wheel and the workpiece in the touching position by means of touch-on motion, i.e. the initial position, from where the feed motion is subsequently to this effected during the grinding work. For this purpose it is suggested that during the touch-on movement a sequence of measured values of at least one mode of operating data of the grinding wheel's rotary drive is recorded, which change with the friction torque acting upon the grinding wheel, and the touch-on motion is terminated as soon as the measured values reach a limiting value corresponding with a certain maximum friction torque.

Whilst the proposed control systems for feed and touch-on motions are equal in terms of the principle of the process, the two differ mainly in that in the first case a specific sequence and in the second case a non-specific sequence of measured values are recorded respectively and that the limiting value represents in the one case the friction torque after grinding abrasion, yet in the other case before commencing grinding work, whereby the latter quoted case includes the two alternatives, that during touch-on motion either a relative position of the grinding wheel is reached, from which point feed motion initially still has to take place before grinding begins, or a relative position of the grinding wheel is already reached at the end of the touch-on motion relative to the workpiece as at the end of a feed motion.

The new control process for touch-on motion functions very sensitively and precisely. Thus the possibility is now offered of providing for a two-phase touch-on motion, whereby the fine touch-on motion which takes place in the second phase is controlled in accordance with the process according to the invention, whilst the above rough touch-on motion is able to be controlled in another way e.g. by optical or mechanical means. Where electrically conductive grinding wheels and workpieces or measuring sensors are utilized, of particular preference is the combination of the fine control system according to the invention in the touch-on motion's final phase with a control process of the above mentioned first phase in which an electrical sparking voltage is applied between the grinding tool and workpiece or measuring sensor and the touching position is determined by the sparking current. Errors are avoidable by means of the two-phase touch-on, which can occur due to contamination entering the spraking gap during touch-on, and which tend to allow sparks to spark over at a sparking voltage of, e.g. about 200 to 300 volts and allow a specific sparking current to be generated rather than without or with lesser contamination in the sparking gap.

In the preferred form of both the process according to the invention for the control of the feed motion and the process according to the invention for the control of the touch-on motion, the current or power consumption of a pulse-controlled d.c. drive motor of the grinding wheel is measured as a sequence of measured values which form a measure of the friction torque acting upon the grinding wheel, whereby this drive motor is operated preferably during the recording of the sequence of measured values at constant speed. This control process offers the advantage of greater precision in comparison with others processes in which not the current or power consumption, but e.g. the speed change following alterations in the friction torque or other operating data dependent on this are measured.

If specific surfaces arranged in relative positions to one another, e.g. cutting edges, are to be ground, with a preferable practical version of the invention before and/or after grinding one of the surfaces can be touched-on, and the other surfaces can be ground thereafter corresponding with this touching position or feed motions be effected for the purpose of compensating the grinding wheel's wear. Instead of using a specific surface on a workpiece as a reference for automatic grinding of other surfaces, a model surface or a measuring sensor can also be touch-on by the grinding tool and be used as a reference point for all surfaces to be ground.

The process according to the invention offers a particularly large advantage for the purpose of controlling the touch-on motion, if the control of the feed motion is also subsequently effected in accordance with the process proposed for this purpose, because then the same control device is able to be utilized for the control both of the touch-on and of the feed motion.

Even further advantages are achieved if in another preferred form of the invention a workpiece is initially machined using a first tool by spark erosion or is erosion ground and then by mechanical abrasion in the same chuck by means of a grinding wheel which is located in the approximated touch-on position by means of a sparking current. With this variant not only is the touch-on motion effected quickly and automatically, but additionally, precision is also promoted, in that in the case of the two succesively performed, differing machining operations the workpiece remains in the same chuck and the relative positions to both tools is controlled in the same way.

Figure 2:
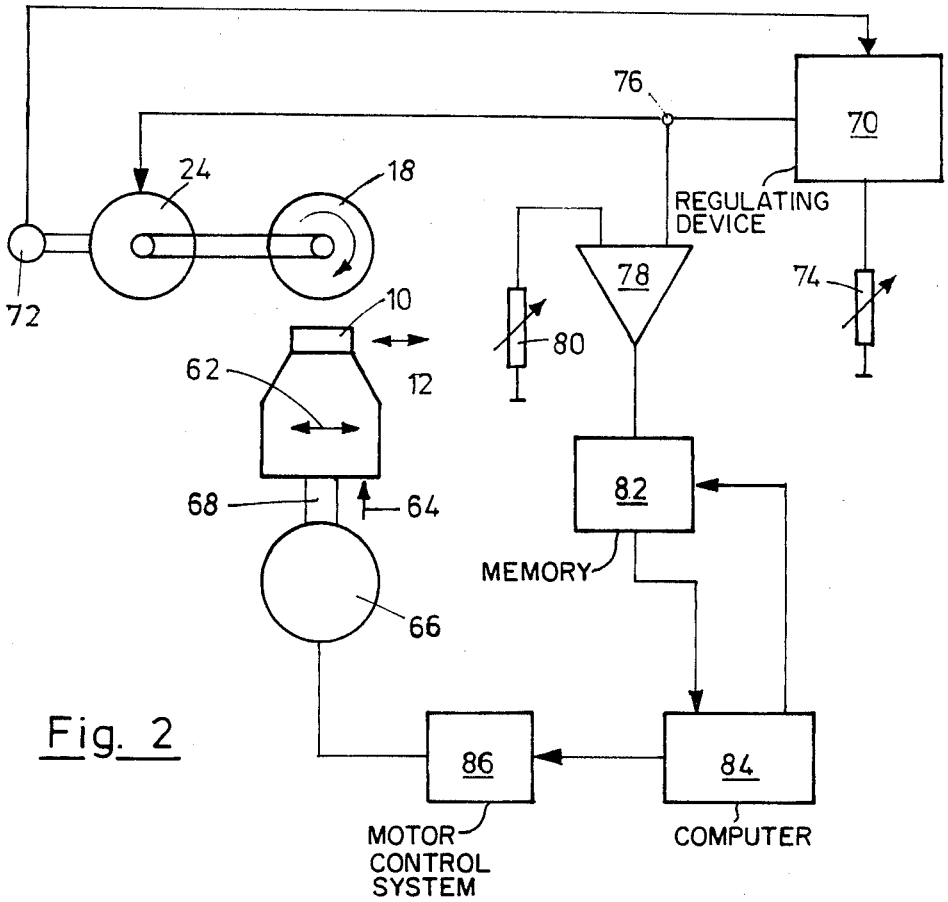
Figure 3:
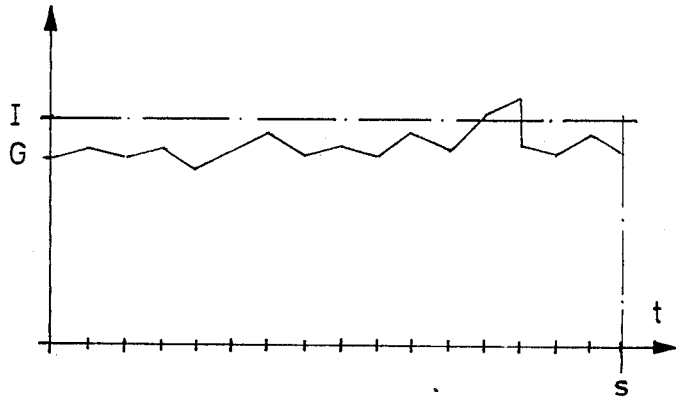

The invention will now be described below in detail with reference to the drawing in which:

FIG. 1 a control circuit diagram of a grinding machine on which machining is being performed by spark erosion or erosion grinding;

FIG. 2 a control circuit diagram of a grinding machine on which the touch-on and feed motion is controlled depending on current consumption of the grinding wheel's drive;

FIG. 3 a diagram of a sequence of current values measured during a grinding operation of the power supply of the grinding wheel in the grinding machine in accordance with FIG. 2.

FIG. 1 shows diagrammatically a workpiece 10, e.g. a saw blade which is clamped onto a compound-slide 12 and is thus able to be moved in the direction of two coordinates x and y located vertically one above the other. A rotary drive 14, whose angle of turn is able to be controlled, serves the purpose of adjusting the angle of turn or indexing the saw blade from one cutting edge to be machined to the next.

Two tools 16 and 18 are provided for machining the workpiece 10. In the case of the tool 16 it deals with a rotary drivable wheel, e.g. made of graphite, copper or another electrically conductive material, possibly also with enclosed grinding grains made of electrically non-conductive material, e.g. diamond grain. The saw blade 10 or another workpiece, e.g. also a milling cutter or another similar tool whose cutters are to be machined, which may consist e.g. of hard metal or polycrystalline diamond, is machined by spark erosion or erosion grinding.

The second tool 18 is an electrically conductive, thus e.g. metal bonded, grinding wheel with for example diamond graining. Both tools 16 and 18 are seated on the same drive shaft 20 and can be moved by means of a tool slide 22 in the direction of a z coordinate located vertically on the x and y coordinates. Apart from this the angular speed $\omega$ of the shaft 20, which is driven by a drive motor 24, is controllable.

A spark generator 26 is connected via leads 28 and 30 to the workpiece 10 and the tool 16 or 18 is connected which has been respectively attached. A dielectric can be flushed in between the workpiece 10 and the respective tool 16 and 18 in the normal manner so that they are either insulated by this dielectric or by air from one another and sparks are able to spark over between them when the erosion tool 16 is located in the operating position with the sparking gap spacing necessary for spark erosion, or when the workpiece 10 is touched-on, i.e., contacted, by the grinding tool 18.

The foreseen feed motions, advance motions and reference value settings can be effected in individual cases with the aid of a control circuit 32. The prespecifications for the control circuit can either be entered into the control circuit by hand via a keyboard which is not shown, or by means of a program memory or programmer 34. This can then have the compound-slide execute a movement in the direction of the x coordinate via a lead 36 and a signal converter 38, by which means e.g. the sparking gap between workpiece 10 and tool 16 is influenced. For the purpose of triggering and readjusting a specific sparking gap, the changes in electrical voltage Us at the sparking gap can be read off via a measuring device 40 and alternatively or simultaneously a change in gap current Is can be read off via a measuring device 42 and fed to the control circuit 32 for the purpose of evaluation. A capacitator 44 which is adjustable in stages is available parallel to the sparking path between workpiece and tool, as is well-known in the machining of metal.

Feed motion of the tool can be regulated dependent upon the current Is measured at 42. The proportional value of a current to the size of the sparking gap can be fed to a comparator in which comparison is made with an adjustable reference value.

The movement of the compound slide 12 is controlled in the direction of the y coordinate via a control line 46 and a signal converter 48. This can be e.g. a backward and forward movement of the workpiece when machining straight cutting edges. The extent of the backward and forward movement can be prespecified by means of the program memory 34 or also by a simple reversal by means of a limit switch.

The tool slide 22 is guided in the direction of the z coordinate via a line 50 and a signal converter 52, in order e.g. to effect a height adjustment on the tool 16 or 18.

The speed of the drive motor 24 is controlled by means of the control circuit 32 via a control line 54 and a signal converter 56. In order in the case of the example to finally position the workpiece 10 in another rotational angular position after each stage of machining using a rotational indexing movement in order to machine another tooth, a corresponding signal is fed to the rotary drive 14 of the workpiece 10 from the control circuit 32 via control line 58 and a signal converter 60. For another machining task the rotary drive 14 can, however, also be a constantly rotating motor, if a workpiece is to be machined as a rotating body, whilst rotating about its own axis during machining.

The device shown in the drawing is suitable in principle for the machining of metallic workpieces, indeed particularly for the production and regrinding of tools, in particular with very hard cutting edges, e.g. made of polycrystalline material. For this purpose the cutting edges of the workpiece can be initially machined with the aid of the tool 16 by means of spark erosion or erosion grinding. The still relatively coarse surfaces generated by this machining process, can then be finish-machined in the same chuck as for workpiece 10 and with the employment of the same control circuit as an aid by means of grinding tool 18. For this purpose the possibility exists of machining either one tooth at a time or one cutting edge at a time of workpiece 10 in immediate succession, first using the erosion tool 16 and then the grinding tool 18, or initially machining all teeth or cutting edges using the erosion tool 16 and subsequently in turn all teeth or cutting edges successfully using grinding tool 18. In the second stage of machining with the employment of the grinding tool 18, the sparking current Is is no longer needed for the abrasion of material, other than with the previously mentioned erosion process, but from now on only for the control of the relative position of the workpiece 10 to the grinding tool 18. By this means the workpiece 10 can be quickly and automatically advanced very precisely up to a very specific distance or up to the point of contact with the grinding grains to the grinding tool 18, or vice versa the latter to the workpiece 10, in order to touch-on. The desired starting position for the grinding process, whether in contact or still at a very specific distance between workpiece and tool, is very precisely adjustable in the manner described, because a specific sparking current Is is assigned to each each sparking path between tool and workpiece even in the case of the electrically conductive tool 18, whose value is fed to the control circuit 32 and there compared with a specific reference value for the starting position or touch-on position. The sparking voltage can also be upheld during the mechanical grinding process by means of the grinding wheel 18, in order to generate a sparking current Is to the degree of a measuring or control current and to control the mechanically grinding contact between the grinding wheel 18 and the workpiece 10 in this way. The eroding effect of the sparks is kept to a minimum during this stage of machining, in order not to affect the smoothing effect of the mechanical grinding process.

Control of the touch-on motion by means of the sparking current in the case of the device in accordance with FIG. 1 can be influenced by dirt in the sparking gap. In order to exclude defects caused by this means, the additional control circuit in accordance with FIG. 2 can be utilized. Depending on the control of the touch-on motion, the control device shown in FIG. 2 can also serve to control the feed motion of a grinding wheel, indeed depending in turn on whether this and/or the workpiece consist of an electrically conductive material.

In the case of the device in accordance with FIG. 2 the workpiece is also designated by 10, the workpiece holder by 12, the grinding wheel by 18 and its electrical rotary drive motor by 24. In the case of the example it has been assumed that during grinding the workpiece holder 12 together with workpiece 10 performs a backward and forward movement corresponding with the double arrow 62. The touch-on motion and later the feed motion take place transversely to this in the direction of the arrow 64. A stepping motor 66 serves as a drive for the touch-on and feed motions, which acts upon the workpiece holder 12, e.g. via a positioning spindle 68.

The operating current of the rotary drive motor 24 of the grinding wheel 18 is regulated by means of a regulating device 70 by way of pulse-width control in such a way that it rotates at a constant speed during a specific machining operation. A tachogenerator 72 is attached to the grinding wheel 18 or to its drive motor 24 for the purpose of feedback, which measures the actual speed and reports to the control device 70, so that the power supply of the drive motor 24 can be appropriately altered when deviations from the reference speed occur, in order to counter the speed deviations incurred. The reference value for the speed of the drive motor 24 is adjusted by means of a potentiometer 74 connected to the control device 70.

The current values of the current supply of the drive motor 24 are read off at 76 and fed to a comparator 78, where they are compared with a specific limiting value which is entered via a potentiometer 80. During operation the sequence of measured current values and the limiting value setting are passed onto a current value memory 82 which in turn is connected to a computer 84, in which the current values or their difference from the limiting value setting are counted depending on the control program setting for either one touch-on motion or feed motion and are coordinated in a specific manner until the computer 84 gives a control command to the motor control system 86 of the stepping motor 66 corresponding with the program which has been entered.

The diagram in accordance with FIG. 3 illustrates pictorially the control process taking place between the reading off of the current values at 76 and the issuing of a control command to the stepping motor 66. For this purpose short, equal time intervals appear on the abscissa during a backward and forward movement S of the tool holder 12 in the direction of the arrow 62, whilst the current values I and the limiting value setting for this are marked off on the ordinate. In the case of the example illustrated of a control system for feed motion, almost all current values recorded during the observed backward and forward movement of the tool holder 12 do lie below the limiting value G relative to the grinding wheel 18. This means that the workpiece 10 is already almost ground down to the dimension foreseen up until this point on the surface to be ground. As the current value curve in FIG. 3 shows, in one place, e.g. a somewhat harder area, it has, however, lasted longer, so that at this place one or more measured current values I exceed the limiting value G. With such a current value curve or a similar one which exceeds the limiting value G in one or several places, the computer 84 will not yet give the motor control system 86 of stepping motor 66 any control pulse for a movement in the feed direction 64. It is rather the case that a further backward and/or forward movement of the tool holder 12 takes place in direction of movement 62, i.e. a further grinding operation takes place, during which time a current value curve is recorded in accordance with FIG. 3. As soon as this remains below the limiting value G along the entire path S, a control pulse goes from the computer 84 to the motor control system 86, whereupon the stepping motor 66 advances the tool holder 12 by a prespecified dimension further in direction 64. The current value curve recorded subsequently as the next one in accordance with FIG.3 will lie initially far above the limiting value G immediately after feed motion due to the strong friction between the workpiece 10 and the grinding wheel 18. The friction torque acting upon the grinding wheel 18 falls as the material removel increases, and thus also the current consumption of the rotary drive motor 24, until the current values again sink below the limiting value G and the computer 84 triggers the next feed step of the stepping motor 66 via the motor control system 86.

The possibility even exists for this type of feed control system to have the stepping motor 66 execute differing sizes of feed steps depending on the mean distance of the current value curve according to FIG. 3 from the limiting value G.

It is understood that the feed control system described above in the example is utilizable independent of whether the workpiece 10 and/or the grinding wheel 18 execute a backward and forward movement in the direction of the arrow 62 transversely to the direction of feed 64 during the grinding process, and of whether the workpiece 10 and the grinding wheel 18 consist of electrically conductive materials.

The control process described and the diagrammatically illustrated control device in accordance with FIG. 2 are, however, also suitable for the control of a touch-on motion before the commencement of a grinding process, in order to bring the grinding wheel and the workpiece into the relative starting position. In this case the current values I in the version by way of the example according to FIG. 2 and 3 are not determined during the backward and forward movement in the direction of the arrow 62, but during the touch-on motion in the direction of the arrow 64, which is generated by the stepping motor 66. In so doing the sequence of current values I remains initially below a specific limiting value G, as long as no contact whatsoever takes place between the grinding wheel 18 and the workpiece 10. The occurrence of contact is made noticeable immediately by a strong increase in the current values I due to the friction torque acting upon the grinding wheel 18, whereby the low limiting value setting G is exceeded and thereupon the touch-on motion is immediately terminated.

In order to obtain the optimum determined hitherto of an automatic, very fast, very reliable and also finally even very precise touch-on control system, an electrically conductive grinding wheel 18 should also be utilized when grinding electrically conductive workpieces, so that the fine touch-on motion described in conjunction with FIG. 2 and 3, dependent upon the friction torque exerted on grinding wheel 18, can be combined with the touch-on control system depending on the sparking current as explained above in connection with FIG. 1. The invention can also be utilized where electrically non-conductive workpieces are to be ground, if a measuring sensor, which is attached in a corresponding location to the workpiece and serves as a reference point, being made of electrcially conductive material is available for touching-on at the beginning and end of a grinding process, which the grinding wheel is able to touch onto by means of measuring the sparking current and the friction torque.

I claim:

1. Process for the control of the step-by-step feed motion of a grinding wheel which is moved backward and forward relative to a workpiece surface to be machined parallel to the latter, wherein for each backward and forward motion of the grinding wheel a sequence of measured values of at least one mode of operating data of the grinding wheel's rotary drive is recorded each time, which values change with the friction torque acting upon the grinding wheel, and a feed motion occurs as soon as all measured values in a sequence remain on that side of a limiting value on which a maximum friction torque assigned to this limiting value is not exceeded.

2. Process according to claim 1 wherein the current or power consumption of a pulse width controlled electrical drive motor of the grinding wheel is measured.

3. Process for the control of relative touch-on motion between a grinding wheel and a workpiece or a measuring sensor, wherein during the touch-on motion a sequence of measured values of at least one mode of operating data of the grinding wheel's rotary drive is recorded, which values change with the friction torque acting upon the grinding wheel, and the touch-on motion is terminated as soon as the measured values reach a limiting value corresponding with a certain maximum friction torque.

4. Process according to claim 3, wherein the process is executed as the second phase of a two-phase touch-on control method where electrically conductive grinding wheels and workpieces or measuring sensors are utilized, and wherein in the first phase an electrical sparking voltage is applied between the grinding tool and workpiece or measuring sensor and an approximated touch-on position is determined by the sparking current.

5. Process for the control of the touch-on motion according to claim 3, wherein when grinding several surfaces arranged with specific relative positions to one another, one of the surfaces is touched-on by means of a sparking current before and/or after the grinding of this surface and a touching position is thus established, and the other surfaces are ground corresponding with this touching position.

6. Process according to claim 3, wherein the workpiece is initially machined using a first tool by spark erosion or is erosion ground and then by mechanical abrasion in the same chuck by means of a grinding wheel which is positioned in a touching position based on the value of a sparking current.

7. Device for controlling step-by-step feed motion of a grinding tool which is moved backward and forward relative to a workpiece surface, and for controlling relative touch-on motion between the grinding tool and the workpiece or a measuring sensor, wherein for each backward and forward motion of the grinding tool a sequence of measured values of at least one mode of operating data of a rotary drive of the grinding tool is each time recorded, which values change with the friction torque acting upon the grinding tool, and a feed motion occurs as soon as all measured values in a sequence remain on that side of a limiting value on which a maximum friction torque assigned to this limiting value is not exceeded, and wherein during the touch-on motion, a sequence of measured values of at least one mode of operating data of the rotary drive of the grinding tool is recorded, which values change with the friciton torque acting upon the grinding wheel, and the touch-on motion is terminated as soon as the measured values reach a limited value corresponding to a predetermined maximum friction torque, said device comprising a rotating drivable grinding tool, a rotary drive for the grinding tool, a workpiece chuck device, a controllable motion drive, including a stepping motor, for altering the relative position between grinding tool and workpiece, and a control circuit means for controlling the stepping motor during the touch-on and/or feed motion dependent upon a previously measured current supplied to, or the power consumption of, the rotary drive of the grinding tool.

8. Device according to claim 7 further comprising an electrically conductive grinding tool for the grinding of an electrically conductive workpiece, and wherein the grinding tool and the workpiece or a measuring sensor are connected to a spark generator and said control circuit means comprises a control circuit for controlling the motion drive during touch-on motion responsive to sparking current produced by said spark generator, said control circuit being controllable during a mechanical grinding process by means of a program memory and/or a sparking current dimensioned solely as a control current.

9. Device according to claim 8, the grinding tool is connected to the spark generator and a control circuit of a tool with spark erosion action which can be applied while the workpiece remains in the same workpiece chuck.

10. Device according to claim 9, the grinding tool and the spark erosion tool comprises tools which are arranged on the same drive shaft and which are capable of being driven rotatively.

* * * * *